US007470203B1

(12) United States Patent
Stillinger

(10) Patent No.: US 7,470,203 B1
(45) Date of Patent: Dec. 30, 2008

(54) ENHANCED-GRIP PLAY BALLS AND METHODS OF MANUFACTURE

(75) Inventor: Scott H. Stillinger, Monte Sereno, CA (US)

(73) Assignee: Acorn Products, LLC, Monte Sereno, CA (US)

( * ) Notice: Subject to any disclaimer, the term of this patent is extended or adjusted under 35 U.S.C. 154(b) by 138 days.

(21) Appl. No.: 11/259,523

(22) Filed: Oct. 25, 2005

Related U.S. Application Data

(60) Provisional application No. 60/622,144, filed on Oct. 25, 2004.

(51) Int. Cl.
*A63B 37/12* (2006.01)

(52) U.S. Cl. ..... 473/596; 473/574

(58) Field of Classification Search ..... 473/595–597, 473/599, 603–605, 574, 575, 615
See application file for complete search history.

(56) References Cited

U.S. PATENT DOCUMENTS 1,559,117 A * 10/1925 Maynard ..... 473/596
1,812,134 A 6/1931 Bragger et al.
1,931,429 A * 10/1933 Buckner et al. ..... 473/596
1,989,703 A 2/1935 Leguillon
2,011,760 A * 8/1935 Milton ..... 473/596
2,448,731 A * 9/1948 Park ..... 473/596
2,931,653 A * 4/1960 Gow et al. ..... 473/596
3,079,644 A 3/1963 Molitor et al.
3,974,319 A 8/1976 Alibeckoff
4,104,435 A 8/1978 Ballesteros
4,660,830 A * 4/1987 Tomar ..... 473/601
4,689,258 A 8/1987 Slosberg et al.
RE33,449 E * 11/1990 Martin ..... 473/613
5,127,648 A * 7/1992 Mallick ..... 473/596
5,133,550 A * 7/1992 Handy ..... 473/596
5,195,745 A * 3/1993 Rudell et al. ..... 473/573
5,228,687 A * 7/1993 Luecke et al. ..... 473/596
5,242,749 A 9/1993 Bayly et al.
5,269,514 A * 12/1993 Adler et al. ..... 473/596
5,383,660 A * 1/1995 Adler et al. ..... 473/596
5,451,046 A * 9/1995 Batton ..... 473/470
5,570,882 A * 11/1996 Horkan ..... 473/438
5,580,049 A 12/1996 Brantley
5,609,953 A 3/1997 Tamura
5,647,590 A 7/1997 Walker et al.
5,722,336 A 3/1998 Takeuchi
5,741,062 A 4/1998 Man
5,941,785 A * 8/1999 Bartels ..... 473/597
6,149,564 A 11/2000 Nozawa et al.
6,261,400 B1 7/2001 Kennedy, III
6,634,970 B2 * 10/2003 Jiminez ..... 473/597

(Continued)

*Primary Examiner*—Steven Wong
(74) *Attorney, Agent, or Firm*—Dascenzo Intellectual Property Law, P.C.

(57) ABSTRACT

Enhanced-grip foamed play balls, such as compressible, foamed play balls that are at least substantially formed from a foamed material and which include an exterior surface that is partially formed from the foamed material and partially formed from discrete regions of a different material that provides a grip-enhancing structure. In some embodiments, the grip-enhancing structure is formed from an elastomer. In some embodiments, the grip-enhancing structure has at least one of greater friction, greater density, greater weight, increased tackiness, decreased porosity, tread structure, projecting tread structure, and/or decreased compressibility than the foamed material. Methods for forming foamed play balls with grip-enhancing structures are also disclosed.

14 Claims, 10 Drawing Sheets

U.S. PATENT DOCUMENTS 6,722,889 B1 * 4/2004 Page et al. ..... 434/251
6,767,300 B2 * 7/2004 Murphy et al. ..... 473/597
6,908,662 B2 * 6/2005 Pearce ..... 428/188
7,029,407 B2 * 4/2006 Lee et al. ..... 473/597
7,048,656 B2 * 5/2006 Litchfield ..... 473/598
2004/0121865 A1 * 6/2004 Lee et al. ..... 473/597

* cited by examiner

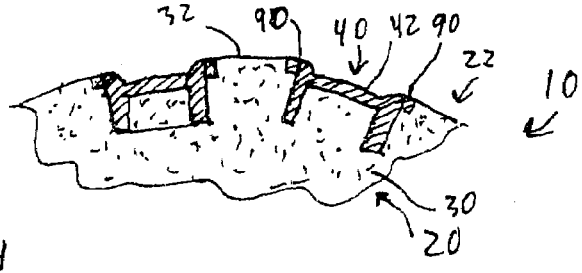
Fig. 34
Fig. 35
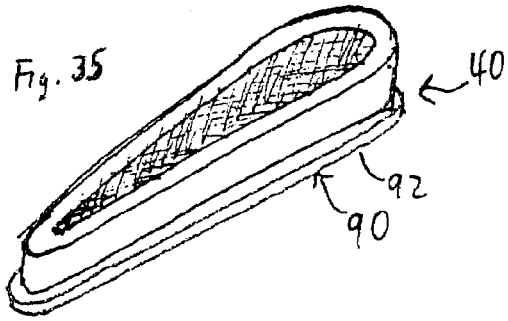
Fig. 36
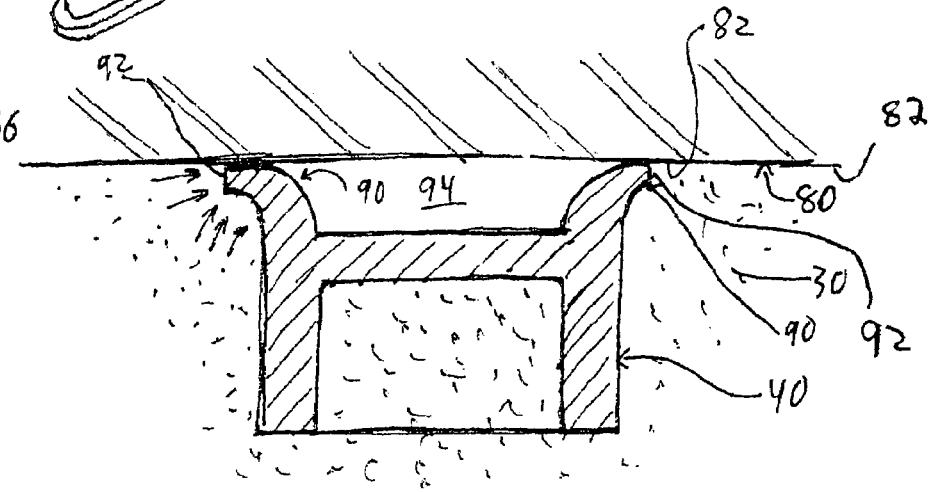
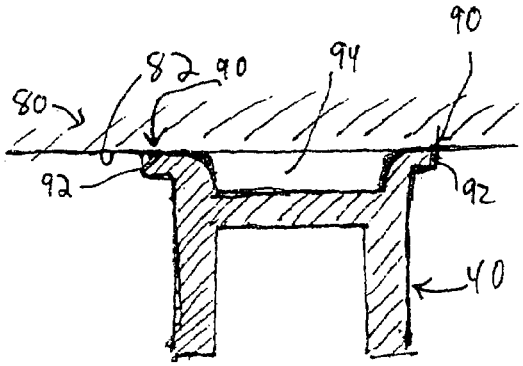
Fig. 37

ENHANCED-GRIP PLAY BALLS AND METHODS OF MANUFACTURE

RELATED APPLICATION

The present application claims priority to U.S. Provisional Patent Application Ser. No. 60/622,144, which was filed on Oct. 25, 2004, and the complete disclosure of which is hereby incorporated by reference for all purposes.

FIELD OF THE DISCLOSURE

The present disclosure is directed to recreational products, and more particularly to play balls containing a foamed material.

BACKGROUND OF THE DISCLOSURE

Many play balls have been developed for use in various sports, games, and other recreational activities. In many of these activities, the play balls are relatively soft, such as being formed from a foamed material, and the balls are intended to be caught by a child or other participant. These conventional balls provide a safe way to participate in these activities because the foamed material is soft and absorbs the energy of impact. Similarly, the compressibility and resiliency of the foamed material enables the ball to strike participants or other objects without injury. Because a foam ball does not rely upon an inflated bladder to provide its shape and/or properties, foam balls tend to be more durable than bladder-based balls. For example, a foam ball may be punctured or cut and will generally retain its original construction and properties.

Current foam balls are generally made by one of two methods. One is to start with a quantity, or bun, of foam material, usually polyurethane foam, and grind it into the desired shape. For example, this bun may be ground to a sphere, a football shape, etc. The exterior surface of this ball is often simply the raw foam material. In other words, the surface and interior of the ball have the same construction. In a variant of this conventional process, a surface coat is sprayed or otherwise coated onto the shaped foam.

The second conventional method is to mold the ball using a two-part polyurethane system. The two parts of the polyurethane system are mixed and then dispensed into a mold. The mixed materials are secured within the mold and then cured with heat. The foam expands to fill the cavity and then hardens into the final product. In this process, the surface finish of the ball is formed in one of two ways. First, a "self-skinning" foam is used in which the foam itself forms a skin on the surface of the ball. The second is to spray a "barrier coat" on the surface of the mold prior to dispensing the foam. This sprayed-on surface then becomes the surface of the ball. Both of these methods provide a surface that is cosmetically pleasing but has relatively low friction and therefore makes the ball somewhat slick and difficult to grasp, such as when throwing or catching the ball.

While the construction of these foamed play balls makes them suitable for use by children and/or in settings where hard or full-sized sporting articles are not appropriate, the resilient nature of these balls tends to make them harder to catch and to accurately throw due to the spongy, resilient construction of the ball and the lack of an effective grip surface on the exterior of the ball.

SUMMARY OF THE DISCLOSURE

The present disclosure provides compressible, foamed play balls that are at least substantially formed from a foamed material and which include an exterior surface that is partially formed from the foamed material and partially formed from discrete regions of a different material that provides a grip-enhancing structure. In some embodiments, the grip-enhancing structure is formed from an elastomer. In some embodiments, the grip-enhancing structure has at least one of greater friction, greater density, greater weight, increased tackiness, decreased porosity, tread structure, projecting tread structure, and/or decreased compressibility than the foamed material. Methods for forming foamed play balls with grip-enhancing structures are also disclosed.

BRIEF DESCRIPTION OF THE DRAWINGS

FIG. 34 is a fragmentary cross-sectional view of another grip-enhancing play ball constructed according to the present disclosure.

FIG. 35 is a rear isometric view of the grip-enhancing structure shown in FIG. 34.

FIG. 36 is a fragmentary cross-sectional view showing another play ball with grip-enhancing structure and a portion of another mold that may be used to form the enhanced-grip play ball according to the present disclosure.

FIG. 37 is a fragmentary cross-sectional view showing another play ball with grip-enhancing structure and a portion of another mold that may be used to form the enhanced-grip play ball according to the present disclosure.

DETAILED DESCRIPTION AND BEST MODE OF THE DISCLOSURE

Figure 1:
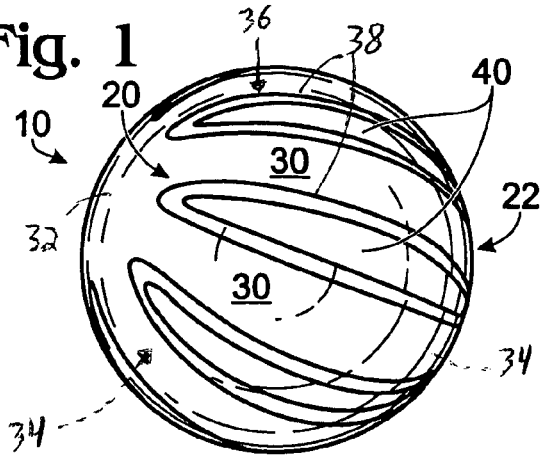
FIG. 1 is a perspective view of a foamed play ball with grip-enhancing structures constructed according to the present disclosure.
Figure 2:
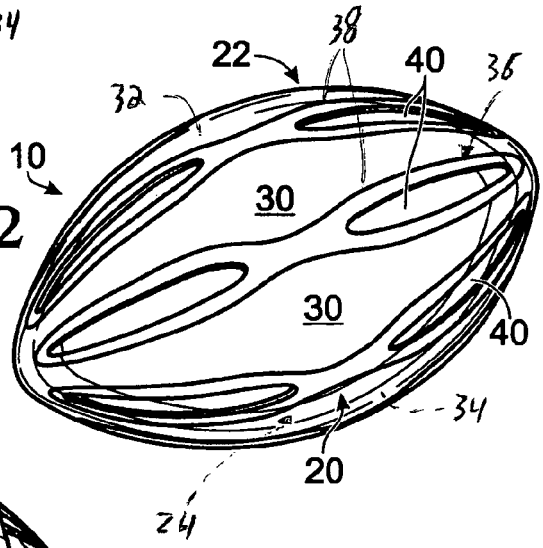
FIG. 2 is a perspective view of another foamed play ball with grip-enhancing structures constructed according to the present disclosure.

The present disclosure is directed to play balls that are substantially formed from a foamed material. Play balls 10 according to the present disclosure may have any suitable regular or irregular shape. For example, the play balls may have spherical shapes, or shapes that resemble conventional sports balls, such as footballs, soccer balls, baseballs, tennis balls, softballs and the like. Illustrative, non-exclusive examples of play balls constructed according to the present disclosure are shown in FIGS. 1 and 2 and are indicated generally at 10. In FIG. 1, ball 10 has a spherical, or generally spherical, configuration, while in FIG. 2 ball 10 has a football shape that includes generally opposed projecting end regions. Play balls 10 constructed according to the present disclosure may also have irregular shapes, such as including projecting tails, projecting fins, surface ridges, surface depressions, etc. Therefore, the term "ball" is not intended to require or preclude a spherical overall or cross-sectional configuration for play balls 10.

As illustrated in FIGS. 1 and 2, play balls 10 according to the present disclosure include a body, or body portion, 20 and have an exterior surface 22 and an internal region 24. The exterior surface 22 of play balls 10 according to the present disclosure includes a region 32 that is formed from a foamed material 30 and a region 36 that is formed from a grip-enhancing structure 40. Region 32 may be referred to as the foamed region of the play ball's exterior surface, and region 36 may be referred to as the grip-enhancing region of the play ball's exterior surface. As discussed in more detail herein, regions 32 and/or 36 may, but are not required to, include a plurality of spaced-apart sub-regions. For example, in the illustrative examples shown in FIGS. 1 and 2, grip-enhancing region 36 includes a plurality of spaced-apart sub-regions 38 of grip-enhancing structures 40 that are bounded by foamed material 30. It is also within the scope of the present disclosure that the grip-enhancing structure may define spaced-apart sub-regions of foamed region 32.

Figure 3:
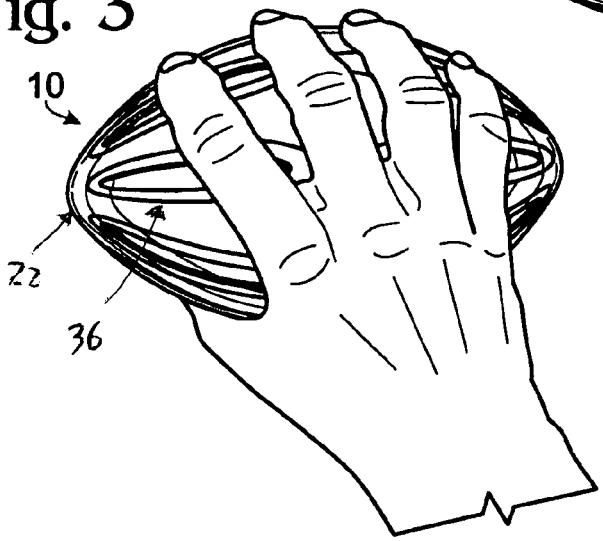
FIG. 3 is a perspective view of a user holding a foamed play ball with grip-enhancing structures according to the present disclosure.

Although not required, play balls 10 will typically have a cross-sectional area in at least one dimension of less than 100 $in^2$, and in some embodiments, less than 80 $in^2$, less than 50 $in^2$, less than 30 $in^2$, less than 20 $in^2$, less than 10 $in^2$, in the range of 6-20 $in^2$, in the range of 10-40 $in^2$, and in the range of 20-30 $in^2$. Play balls with cross-sectional areas that are outside of these illustrative ranges are still within the scope of the present disclosure. Play balls 10 according to the present disclosure may be sized to be thrown and/or caught by a user with a single hand, although it is within the scope of the present disclosure that play balls 10 may also have larger sizes that are more suitable for two-handed catches and/or throws. FIG. 3 illustrates an example of a play ball 10 that is adapted to be held in a user's hand, such as for throwing and/or catching the ball. As shown, the user's hand extends in contact with grip-enhancing region 36 of the play ball's exterior surface 22.

Foamed material 30 may, but is not required to, form at least a majority of the body's uncompressed volume. In some embodiments, at least 60%, at least 75%, or more of the body's uncompressed volume is formed from foamed material 30. Accordingly, many play balls 10 according to the present disclosure may be described as having an internal region 24 that is at least substantially, if not completely, formed from foamed material 30. As used herein, the term "foamed material" is intended to refer to any suitable number (one or more), composition(s), and/or density(ies) of foamed materials that collectively form a majority (by uncompressed volume) of the play ball. Illustrative, non-exclusive examples of suitable foamed materials include polyurethane, such as two-part curable polyurethane foams, although others may be used.

The foamed material forming foamed region 32 of the play ball's exterior surface 22 may have the same construction and composition as the portion of the rest of the ball's body 20 that is formed from foamed material 30. For example, foamed region 32 may be formed from raw foam that does not include a surface layer having a different composition, density, or the like as the foamed material present beneath the ball's exterior surface. As another illustrative, non-exclusive example, the foamed material 30 forming foamed region 32 of the ball's exterior surface may have a surface coating, as indicated in dashed lines at 34 in FIGS. 1 and 2. Self-skinning foams and barrier-coated foams are illustrative, non-exclusive examples of foamed materials that have a surface layer having a different construction than the interior portion of the foamed material.

Figure 4:
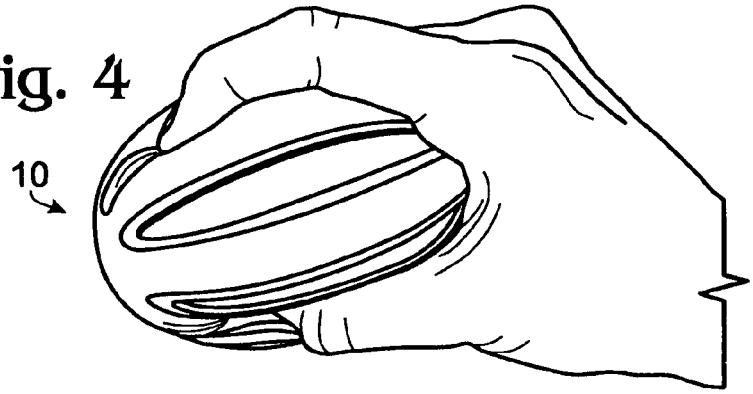
FIG. 4 is an elevation view illustrating the compressible nature of play balls according to the present disclosure.

Play balls 10 according to the present disclosure are compressible, which enables them to be easily squeezed within a user's, even a child's, hand, while also being resilient so that they are biased to automatically return to their neutral, or uncompressed, configuration. As used herein, "compressible" refers to a material that is adapted to be compressed to at least 60%, if not at least half, at least 40%, or even at least 25%, at least 10%, or less, of its original dimension (such as at least one of diameter, width, and length) by squeezing the material between a user's fingers or otherwise within a user's hand. Accordingly, a "compressible, resilient" play ball according to the present disclosure is designed and/or otherwise adapted to be compressed to a reduced dimension (such as one of the illustrative dimensions described, illustrated, and/or incorporated herein) by a user squeezing the ball between the user's fingers or otherwise squeezing the ball in the user's hand. FIG. 4 illustrates an example of the play ball 10 of FIG. 1 being compressed in a user's hand, such as by a user squeezing the play ball. The relative degree of compression illustrated in FIG. 4 is intended for illustrative, non-limiting purposes. Upon release of the ball by the user, the ball will automatically return to its uncompressed configuration, such as shown in FIG. 1.

Foamed material 30 may be selected or otherwise tailored to have selected properties depending on the intended use of the play ball 10 formed therefrom. Properties that can be controlled, or influenced, by the selected foamed material include, but are not limited to, one or more of the density, weight, stiffness, surface finish, color, and resilience of the material. For example, the resiliency of the foamed material affects the bounce, or spring, in the play ball, such as when it strikes a surface or when a user tries to catch it. The weight of the foamed material also affects the distance that the play ball will travel when thrown with a particular force, as well as the force of impact of the play ball. For example, when forming a play ball 10 that is intended to be thrown outdoors, such as for longer distances, it may be desirable for the play ball to have more weight, such as by being formed from a denser foamed material, than a play ball 10 that is intended for indoor use. By selecting the resiliency of the foamed material, the amount of bounce, or rebound, of the foamed ball may be influenced. For example, a less resilient foamed material may be used to make the play ball easier to catch, especially when thrown with force. In this way, it is easier to catch such a play ball because it is less likely to bounce out of a user's hands as the user tries to grasp it. Despite these variables that may be influenced through the selection of the foamed material, the above-discussed limitations of conventional foamed play balls still exist in play balls that do not include grip-enhancing structure 40.

As discussed, play balls 10 according to the present disclosure further include grip-enhancing structure 40 that extends across a portion, but not all, of the exterior surface 22 of the play ball, thereby defining a grip-enhancing region 36 of the exterior surface. Grip-enhancing structure 40 is formed from a material having a greater density and less compressibility than foamed material 30. This material may have the same or a different composition from the foamed material. In some embodiments, the material from which the grip-enhancing structures are formed and the foamed material may have at least one common component. Grip-enhancing structure 40 preferably is formed from one or more materials having greater friction (and/or coefficient of friction) and/or tackiness than the foamed material, thereby promoting a better grip by a user than a conventional foam ball that does not include grip-enhancing structure 40. Similarly, the grip-enhancing structure may (but is not required to) be formed from one or more materials having greater density than the foamed material, thereby promoting increased weight in a play ball constructed according to the present disclosure than in a play ball that does not include grip-enhancing structure 40. While not required, increased relative weight positioned at the exterior surface of the ball may also be selectively used to increase the rotational inertia of the play ball, such as a football-shaped play ball, when thrown. Grip-enhancing structure 40 may, but is not required to, have a reduced porosity than the foamed material. Grip-enhancing structure 40 will typically be formed from a flexible material, and may be formed from a resilient and/or elastomeric material.

Grip-enhancing structure 40 will typically be formed from one or more flexible materials, which may or may not be at least partially foamed. Illustrative examples of suitable materials for grip-enhancing structure 40 include thermoplastic and other elastomers having soft touch and high friction, such as a styrenic block copolymer (SBC). A common brand name for SBC is Kraton™. An illustrative, non-exclusive example of such a styrenic material is 30 Shore A Kraton. Other illustrative examples of suitable materials for grip-enhancing structure 40 include polyurethane, PVC, and mixtures and compounds thereof. Further illustrative examples include 70 Shore A Dow Pellathane thermoplastic urethane, and 60 Shore A BASF Elastollan. The materials from which the grip-enhancing structure and the foamed material are formed may be selected so that the foamed material adheres to the grip-enhancing structure, such as in embodiments of the play ball where the foamed material is added as a liquid to a mold containing the grip-enhancing structure. In some embodiments, the materials may be selected to be adapted to be adhered or otherwise bonded together through the use of a suitable adhesive.

The grip-enhancing structure extends over, or forms, a portion of the play ball's exterior surface. More specifically, the foamed material and the grip-enhancing structure each form discrete regions of the exterior surface, such as the previously discussed regions 32 and 36. It is within the scope of the present disclosure that either the foamed material or the grip-enhancing structure may form the majority of the play ball's exterior surface. However, grip-enhancing structure 40 will typically extend over, or form, less than half of the exterior-surface of the play ball, including such illustrative examples as 10-50%, 15-40%, 20-45%, 25-50%, less than 40%, less than 25%, at least 15%, etc. of the surface area of the exterior surface of the play ball.

Grip-enhancing structure 40 may be formed from a continuous length of material or two or more regions that, at least on the exterior surface of the play ball, are spaced-apart from each other and surrounded by foamed material 30. For example, the grip-enhancing structure may extend around the diameter of the play ball's exterior surface, around two or more sections of the play ball's exterior surface, along one or more axes of curvature of the play ball's exterior surface, in discrete locations on the exterior surface, in radially spaced configurations relative along the exterior surface, in randomly or non-uniformly spaced configurations on the exterior surface, etc. The above-referenced FIGS. 1 and 2 provide illustrative, non-exclusive examples of play balls 10 with an exterior surface 22 that includes foamed material 30 and grip-enhancing structure 40. As additional examples, the grip-enhancing structure may be located on predetermined gripping regions on the exterior surface, such as regions that are normally contacted to catch and/or throw the play ball. For example, on a play ball 10 in the form of a football, it may be more desirable to include grip-enhancing structure on a central region of the play ball's exterior surface, as opposed to on the ends of the football. An illustrative example of such a play ball 10 is shown in FIG. 2. Accordingly, in some embodiments, the grip-enhancing structure may be positioned so that it does not extend on regions of the play ball's exterior surface that are more likely to impact or contact objects when the ball is thrown.

Figure 5:
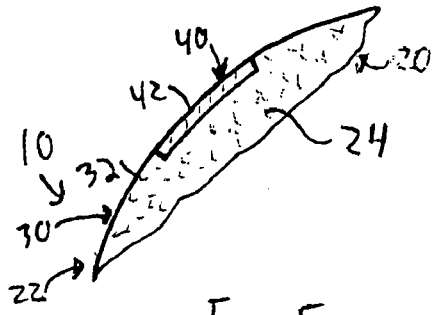
FIG. 5 is a fragmentary cross-sectional view showing an illustrative construction for foamed play balls with grip-enhancing structures according to the present disclosure.
Figure 6:
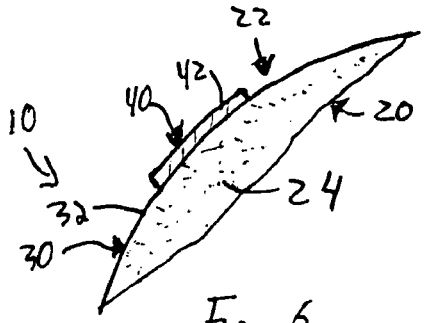
FIG. 6 is a fragmentary cross-sectional view showing another illustrative construction for foamed play balls with grip-enhancing structures according to the present disclosure.
Figure 7:
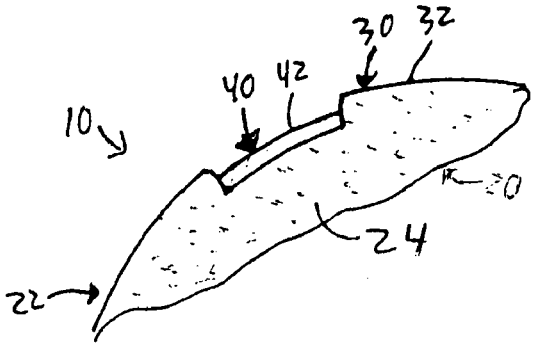
FIG. 7 is a fragmentary cross-sectional view showing another illustrative construction for foamed play balls with grip-enhancing structures according to the present disclosure.
Figure 8:
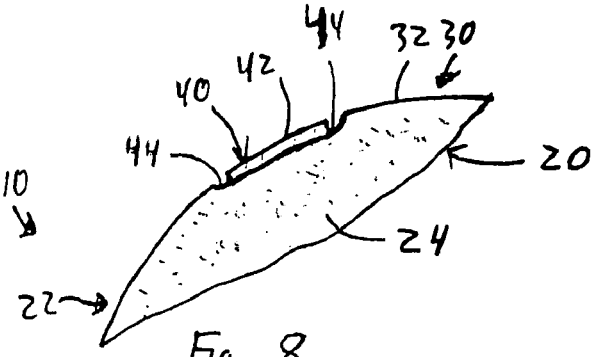
FIG. 8 is a fragmentary cross-sectional view showing another illustrative construction for foamed play balls with grip-enhancing structures according to the present disclosure.

Grip-enhancing structure 40 includes an exterior portion 42 that may extend in a variety of orientations relative to the portion, or region, 32 of exterior surface 22 that is formed by foamed material 30. For example, and as indicated somewhat schematically in FIG. 5, the grip-enhancing structure's exterior portion 42 may be level (i.e., the same distance away from an axis or center of the ball), or extend along the same radial plane or surface, with the region 32 of the external surface formed by foamed material 30. However, this comparatively smooth, or continuous, orientation is not required. To illustrate this point, FIG. 6 demonstrates an example where exterior portion 42 extends above, or projects externally away from, foamed region portion 32, and FIG. 7 demonstrates an example where exterior portion 42 is recessed, or extends away from the axis or center of the play ball less than foamed region 32. In FIG. 8, external portion 42 extends generally to the same distance as foamed region 32, but a recess, or groove, 44 is formed in the foamed material around the grip-enhancing structure. The external portion of the grip-enhancing structure may be described as, or as including, an external surface of the grip-enhancing structure.

Figure 9:
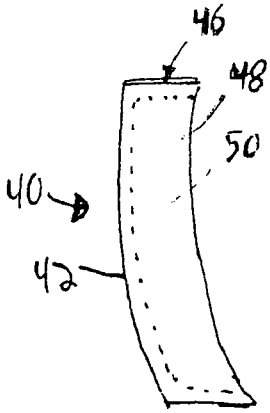
FIG. 9 is a side elevation view showing another suitable configuration for a grip-enhancing structure for play balls according to the present disclosure.

As discussed in more detail herein, it is within the scope of the present disclosure that the grip-enhancing structure may include two or more components, which are either separately secured on the exterior surface of the play ball, or connected to the exterior surface in groups of two or more. The grip-enhancing structure may be shaped to correspond to the curvature of the portion of the exterior surface that it is intended to represent. As an illustrative graphical example, FIG. 9 shows a grip-enhancing structure 40 that includes an exterior portion 42 that is shaped to correspond to the shape of the exterior surface of the play ball within which the structure is adapted for use, such as by having an arcuate, or curved, exterior surface that corresponds to the curvature of the exterior surface of a corresponding play ball. The grip-enhancing structure may be formed from a solid material, may define one or more projecting ribs, projecting treads, surface treads, perimeter portions, recesses, channels, and the like.

Figure 10:
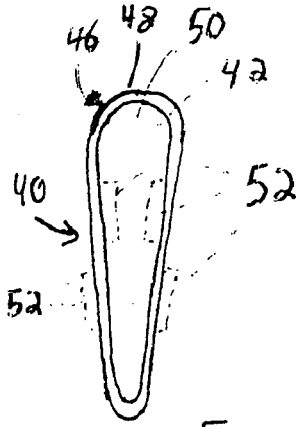
FIG. 10 is a bottom plan view of the grip-enhancing structure of FIG. 9.

It is also within the scope of the present disclosure that the grip-enhancing structure may include regions that extend, or otherwise project, from exterior portion 42 of the grip-enhancing structure into the interior region of the play ball. The example of grip-enhancing structure 40 shown in FIG. 9 also provides an example of a grip-enhancing structure that includes an internal portion, or internal projecting region, 46. In FIG. 9, region 46 takes the form of sidewalls 48 that project from exterior portion 42 and which are adapted to extend within the internal region of a corresponding play ball. As indicated in FIGS. 9 and 10, the sidewalls may define a cavity 50 into which foamed material may extend. As indicated in dashed lines at 52 in FIG. 10, it is also within the scope of the present disclosure that sidewalls 48, or other internal portions 46, may include projecting anchors, or flanges that are adapted to provide regions around, and over, which the foamed material extends, such as when the play ball is formed by injecting the foamed material into a mold containing the grip-enhancing structures. The internal projecting region, when present, may provide a surface that increases the frictional interaction between the grip-enhancing structure and the foamed material and/or may provide a surface to which the foamed material may adhere. Accordingly, increasing the surface area of this region, when present, may promote greater retention of the grip-enhancing structure to the body of the ball.

Figure 11:
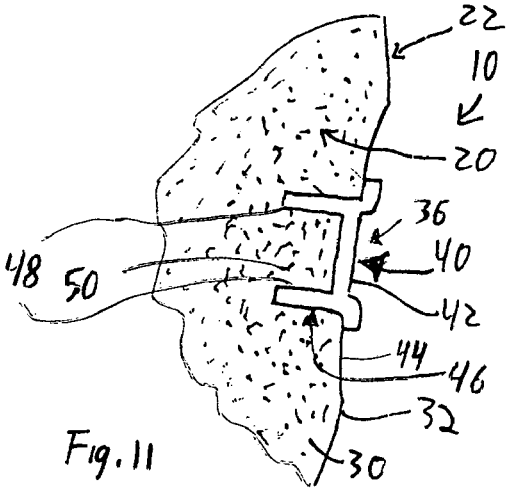
FIG. 11 is a fragmentary cross-sectional view of another illustrative construction of an enhanced-grip play ball according to the present disclosure.

In FIG. 10, sidewalls 48 are shown as defining a continuous surface around a perimeter region of the grip-enhancing structure's exterior portion 42, and anchors 52 are shown as being a plurality of spaced-apart structures. It is within the scope of the present disclosure that sidewalls 48, when present, may take the form of two or more spaced-apart, or discontinuous, structures and/or that anchors 52, when present, may form continuous or discontinuous structures and/or may project inwardly and/or outwardly relative to the sidewall or other internal portion of the grip-enhancing structure. FIG. 11 provides another illustrative example of a portion of a play ball 10 that includes a grip-enhancing structure 40 with an exterior portion 42 and an internal projecting region 46 in the form of a pair of spaced-apart sidewalls 48 that define a cavity 50 therebetween. FIG. 11 also provides an example of a play ball 10 in which the ball's exterior surface 22 includes a recess, or cavity, 44 separating the foamed region 32 and the grip-enhancing region 36. In the illustrative example of a grip-enhancing structure shown in FIG. 11, the structure includes an exterior portion having a perimeter region and a recessed central region. As discussed, it is also within the scope of the present disclosure that the entire exterior portion has the same configuration, that the central region projects radially outwardly relative to the perimeter region, that the central and perimeter regions both include outwardly projecting regions, etc.

Figure 12:
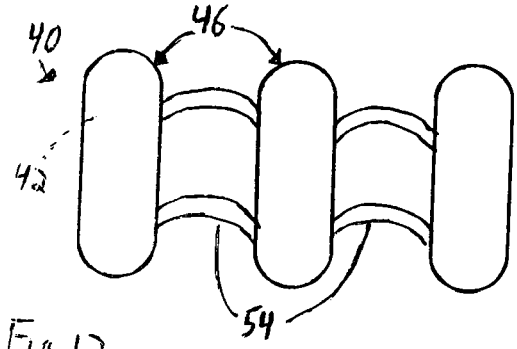
FIG. 12 is a perspective view of showing another suitable configuration for a grip-enhancing structure for play balls according to the present disclosure.
Figure 14:
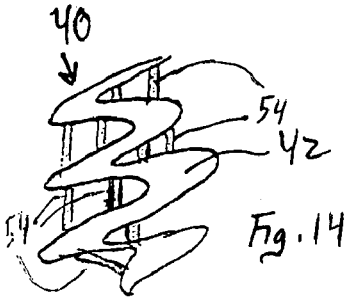
FIG. 14 is a perspective view of another suitable configuration for a grip-enhancing structure for play balls according to the present disclosure.
Figure 13:
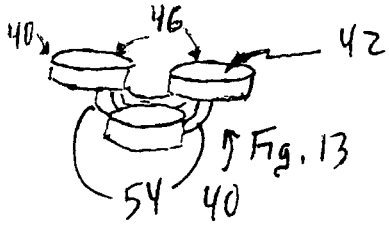
FIG. 13 is a perspective view of another suitable configuration for a grip-enhancing structure for play balls according to the present disclosure.
Figure 15:
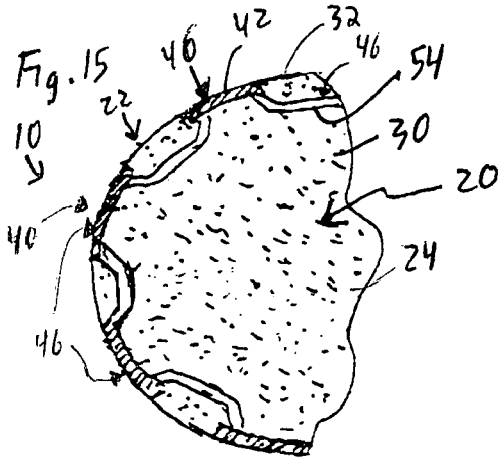
FIG. 15 is a fragmentary cross-sectional view of another illustrative construction of an enhanced-grip play ball according to the present disclosure.

Another illustrative example of an internal portion 46 for grip-enhancing structures according to the present disclosure is internal portions that interconnect spaced-apart exterior portions 42. In such a configuration, the grip-enhancing structure may be described as including exterior portions 42 that are connected by linkages, or bridges, 54 that are adapted to extend beneath the exterior surface of the play ball. The linkages may enable the exterior portions to be positioned as a group, rather than individually. The linkages may also cooperate to secure, or anchor, the grip-enhancing structure to the foamed material by forming internal projections around which the foamed material extends. Illustrative examples of grip-enhancing structures 40 that include internal linkages 54 interconnecting spaced-apart exterior portions 42 are shown in FIGS. 12-14. An illustrative example of a play ball 10 that includes a grip-enhancing structure with internal linkages is shown in FIG. 15.

Figure 16:
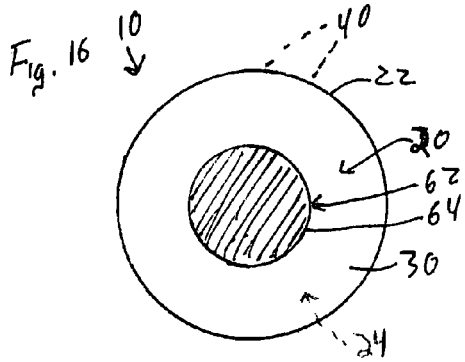
FIG. 16 is a schematic diagram showing another suitable construction for the internal body portion of an enhanced-grip play ball according to the present disclosure.
Figure 17:
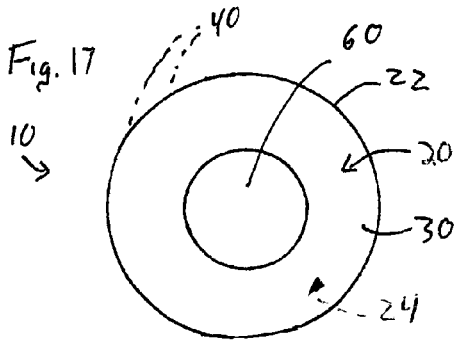
FIG. 17 is a schematic diagram showing another suitable construction for the internal body portion of an enhanced-grip play ball according to the present disclosure.

Although discussed as having bodies that are at least substantially formed from foamed material 30, it is within the scope of the present disclosure that play balls 10 may include bodies 20 that include a central void, or cavity, 60 or a central core 62 that is formed from a solid material 64. A solid core will provide a play ball having greater weight than an otherwise constructed play ball that does not include such a core, while a play ball having a central void may be more compressible and will be somewhat lighter than a similarly constructed play ball without such a void. Schematic representations of these illustrative internal constructions are shown in FIGS. 16 and 17. Play balls 10 according to the present disclosure that do not include an internal sealable bladder, such as is commonly used in inflatable balls like volley balls, soccer balls, beach balls, footballs, and the like, may also be referred to as bladder-less play balls, or play balls.

It is also within the scope of the present disclosure that the body of the play ball may include internal supports 70, such as inserts 72 and/or frames 74, that are separately formed from the foamed material and which are adapted to position and/or support the grip-enhancing structure. For example, preformed foamed or and/or flexible inserts 72 may be used to interconnect portions of the grip-enhancing structure, such as spaced-apart regions on a continuous length of grip-enhancing structure or to interconnect separately formed components of the grip-enhancing structure. For example, the frame or insert may include mounts 76 that are positioned and/or shaped to receive a corresponding portion of the grip-enhancing structure, such as may (but is not required to) include a complimentary mount or connecting portion. Flexible frames may be formed from such illustrative materials as polyethylene and/or polypropylene, amongst others, and may have foamed or non-foamed constructions. Inserts 72 and frames 74, when present, will typically have a resilient and/or compressible construction.

Figure 19:
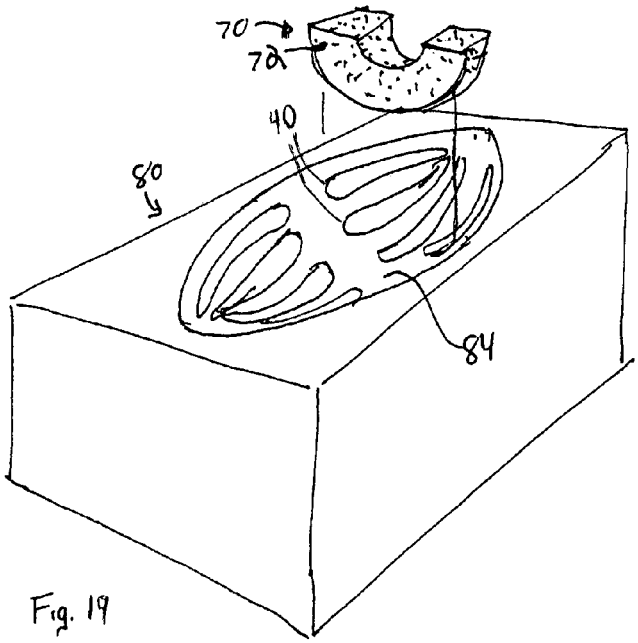
FIG. 19 is a perspective view showing another suitable construction for an insert for the internal body portion of an enhanced-grip play ball according to the present disclosure, with the insert shown positioned above a portion of a mold that may be used to form the play balls.
Figure 20:
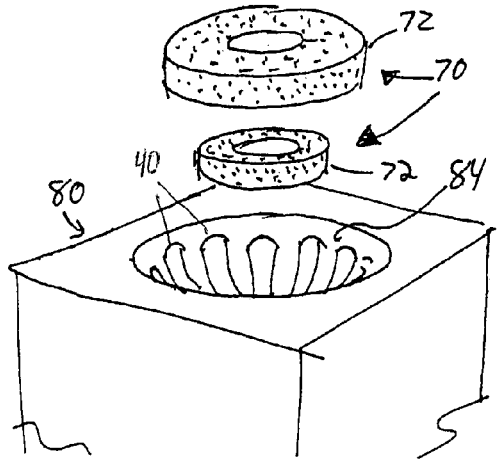
FIG. 20 is a perspective view showing another suitable construction for inserts for the internal body portion of an enhanced-grip play ball according to the present disclosure, with the inserts shown positioned above a portion of a mold that may be used to form the play balls.
Figure 18:
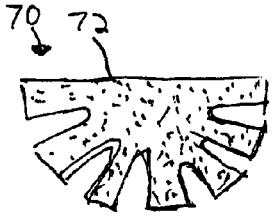
FIG. 18 is a side elevation view of a foamed insert that may be used in the internal body portion of an enhanced-grip play ball according to the present disclosure.

Illustrative examples of internal supports are shown in FIGS. 18-22. In FIG. 18, support 70 takes the form of a foamed insert 72 that is adapted to be placed inside a mold prior to the injection of the foamed material. The insert may be adapted to support or otherwise position the grip-enhancing structures of the corresponding play ball within the mold, such as by extending against the grip-enhancing structure, at least prior to the insertion of the moldable material. For example, the support may be used to bias, or urge, the grip-enhancing structures against the interior surface of a mold during formation of a play ball. Additionally or alternatively, foamed inserts may be adapted to define regions of the play ball that have greater or lesser density and/or compressibility than the regions formed by foamed material that is injected into the mold. FIGS. 19 and 20 provide additional examples of supports 70, such as preformed inserts 72, that are adapted to provide support to grip-enhancing structures 40 during formation of the play ball, namely, during a molding process in which foamed material 30 is injected into a mold, or mold portion, 80 that includes a mold cavity 84 that defines the shape of the play ball and includes the grip-enhancing structure (and any preformed frame, insert or other support). Mold cavity 84 may be referred tot as an internal cavity, and mold 80 may be described as having an interior surface 82 that at least substantially, if not completely, defines the shape and size of the mold cavity. FIG. 20 provides a graphical example that two or more supports 70 may be used in a play ball 10 according to the present disclosure. The illustrative, somewhat schematic, examples of molds 80 shown in FIGS. 19 and 20 represent halves of a mold. It should be understood that the complete mold will include an opposed mold half, with the halves being secured together to define the shape of the molded ball. The halves may have the same or different configurations, but typically will define a corresponding boundary where the mold halves are secured together.

Figure 21:
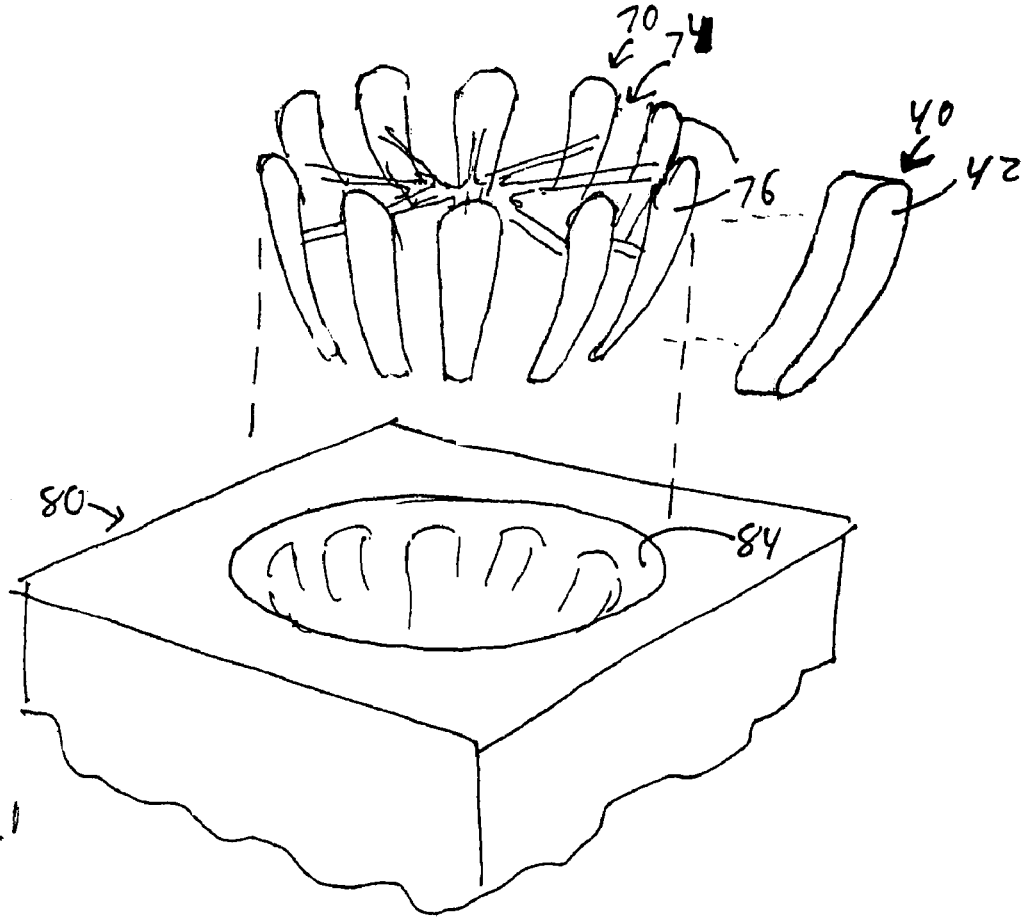
FIG. 21 is a perspective view showing illustrative construction for an internal frame that may be used in the internal body portion of an enhanced-grip play ball according to the present disclosure, with the frame shown positioned above a portion of a mold that may be used to form the play balls.
Figure 22:
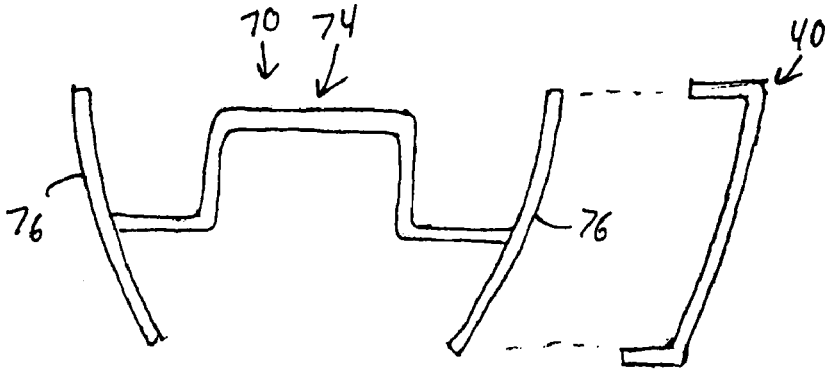
FIG. 22 is an exploded side elevation view of another suitable construction for a frame and a grip-enhancing structure for an enhanced-grip play ball according to the present disclosure.

FIG. 21 provides an example of a support 70 in the form of an internal frame 74 that is adapted to interconnect two or more preformed grip-enhancing structures 40, such as with mounts 76. Frame 74 may be formed from a flexible and/or resilient material, and may be adapted to bias or otherwise urge the grip-enhancing structures toward the exterior of the play ball, and during the molding process, toward the interior surface of the mold cavity. Another illustrative example of an internal frame 74 is shown in FIG. 22. As shown, the frame is adapted to receive and position a plurality of grip-enhancing structures 40 upon corresponding mounts 76, with the frame and the attached grip-enhancing structures being inserted into the cavity 84 of a mold 80 into which foamed material will thereafter be injected or otherwise inserted. Frame 74 may have a resilient construction, such as to bias the associated grip-enhancing structures away from the center of the ball's body while also enabling the grip-enhancing structures to be compressed toward the center of the play ball when the ball is squeezed by a user.

Any suitable process or method may be used to form play balls 10 according to the present disclosure, such as the play balls described, illustrated, and/or incorporated herein. In other words, play balls 10 having an exterior surface 22 having at least one discrete foamed region 32 and at least one discrete grip-enhancing region 36, including exterior surfaces where the foamed region forms a majority portion of the exterior surface, are within the scope of the present disclosure regardless of the method used to form the play ball. However, illustrative and non-exclusive examples of suitable methods for forming play balls 10 are described, illustrated and/or incorporated herein.

Figure 23:
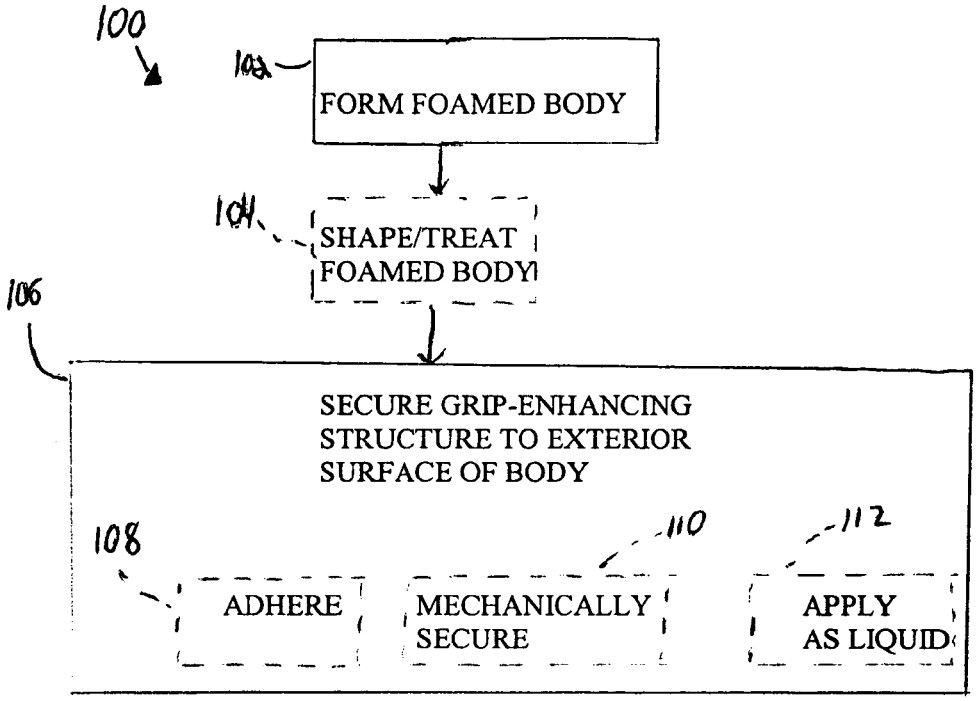
FIG. 23 is a flow chart illustrating non-exclusive examples of suitable methods for forming enhanced-grip play balls according to the present disclosure.

FIG. 23 is a flowchart illustrating at 100 a first set of suitable, non-exclusive methods for forming play balls 10 according to the present disclosure. Methods 100 involve separately forming the foamed and grip-enhancing regions of the play ball and thereafter securing the grip-enhancing structures that form grip-enhancing regions of the play ball's exterior surface to the preformed foamed material. As indicated in FIG. 23 at 102, the foamed body, or body portion, of the play ball is formed. This body portion may be entirely formed of the foamed material, or it may include a core or insert, such as described, illustrated and/or incorporated herein. As discussed, this forming step may include molding the body portion, although other methods may be used, such as grinding, machining, cutting, or otherwise removing material from a larger mass of foamed material to produce the body portion. At 104, the body is optionally shaped. This shaping may include cutting, grinding, machining, or otherwise shaping the body into the desired shape for the play ball and/or to form recesses or other suitable mounts on the body for the grip-enhancing structure. Either of the forming and/or shaping steps may, but are not required to, include treating the surface of the body portion, such as by applying a sealant or other coating thereto.

At 106, the grip-enhancing structures are secured to the body portion. The grip-enhancing structure will in at least this example typically be separately formed from the foamed ball, such as by molding, cutting, stamping, etc., and thereafter positioned and secured relative to the foamed ball. This securing step may utilize any suitable process or structure, illustrative, non-exclusive examples of which include adhering the grip-enhancing structure to the foamed material, such as via a suitable adhesive, fixative, or bonding agent. Another example of a suitable securing step includes mechanically securing the grip-enhancing structure to the molded material, such as by inserting portions of the grip-enhancing structure, such as internally projecting portions, into recesses or other sockets or mounts that are formed in the exterior surface of the molded material. As discussed and illustrated herein, the sizing of these recesses, when present, may also be utilized to define the relative position of the grip-enhancing structures exterior portions relative to the outer surface of the molded material. As discussed, at least a portion of the grip-enhancing structure may be recessed beneath the portion of the ball's exterior surface that is formed by the foamed material, the grip-enhancing structure's exterior surface may be positioned at, below, or above the portion of the ball's exterior surface that is formed by the foamed material, and/or at least a portion, if not all, of the grip-enhancing structure may extend above (or project outwardly from) the portion of the ball's exterior surface formed by the foamed material.

When recesses are formed in the foamed material to receive the grip-enhancing structure, the recesses may be (slightly) undersized relative to the grip-enhancing structure to be received therein. For example, this may enable the recesses to provide compression to the grip-enhancing structure. It is also within the scope of the present disclosure that the recesses, when present may be precisely sized to receive the grip-enhancing structure, or oversized relative to the grip-enhancing structure to thereby provide a depression or transition region between the portions of the exterior surface formed by the foamed material and the grip-enhancing structure. Additionally, or alternatively, the grip-enhancing structures may be adhesively retained within the recesses.

In a further variation of the above methods that begin by forming and shaping a foam ball, the foam ball may be masked or otherwise coated or covered in selected regions, with the grip-enhancing structure subsequently coated, sprayed, or otherwise applied to the foam ball, such as on the non-masked or uncovered regions. This variant of previously discussed methods that utilize preformed grip-enhancing structures is indicated at 112 in FIG. 23.

Figure 24:
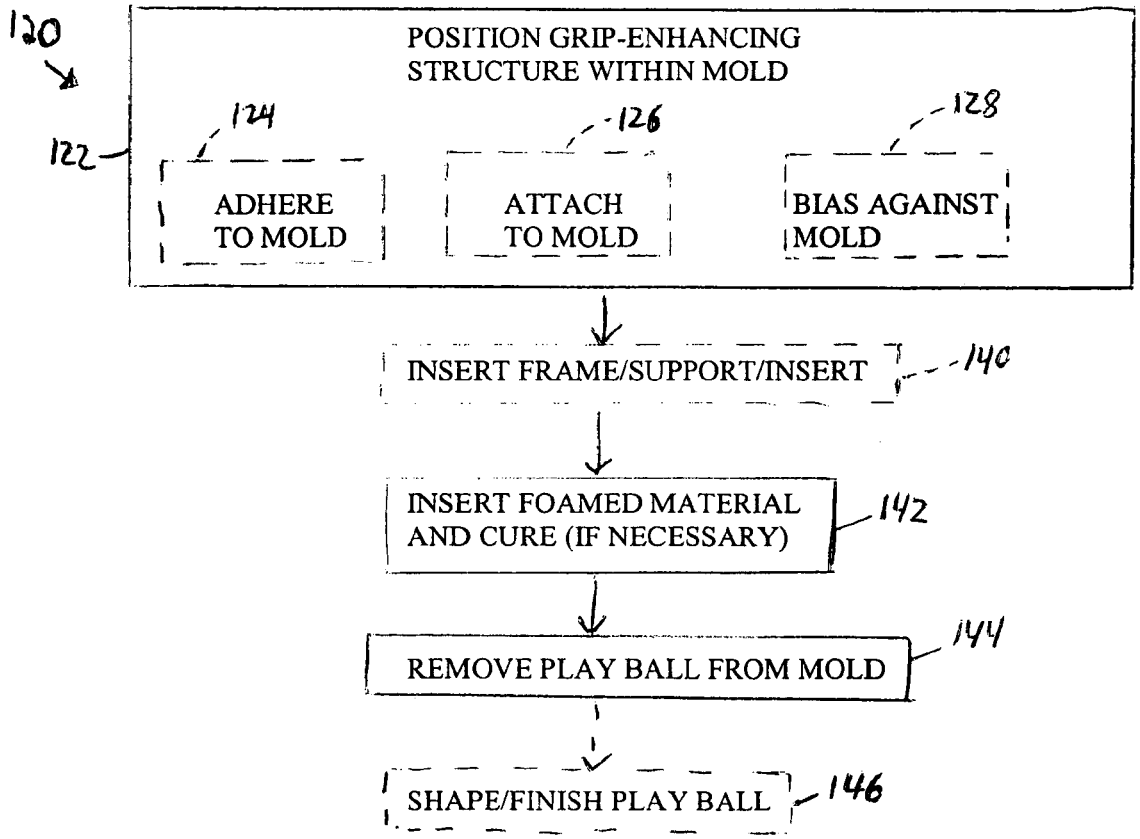
FIG. 24 is a flow chart illustrating additional non-exclusive examples of suitable methods for forming enhanced-grip play balls according to the present disclosure.

Additional illustrative, non-exclusive examples of suitable methods for forming play balls 10 according to the present disclosure are schematically illustrated in FIG. 24 and generally indicated at 120. Methods 120 involve positioning the grip-enhancing structures within a mold and thereafter inserting foamed material into the mold, with the shape of the mold's cavity at least substantially defining the shape of the play ball, including the play ball's exterior surface. When a mold is used, the mold includes an interior surface that defines an internal cavity. This internal cavity, in turn, generally defines the shape and size of the exterior surface of the play ball.

At 122, methods 120 include positioning the grip-enhancing structure(s) 40 relative to the mold, such as relative to the interior surface of the mold cavity. This positioning may utilize any suitable method and/or structure, illustrative, non-exclusive examples of which are indicated in FIG. 24 at 124, in which the grip-enhancing structure is bonded to the mold, at 126, in which the grip-enhancing structure is mechanically attached to the mold, and at 128, in which the grip-enhancing structure is biased against the interior surface of the mold cavity. It is within the scope of the present disclosure that two or more of these illustrative positioning steps may be utilized together. It is also within the scope of the present disclosure that other suitable methods and/or mechanisms for selectively positioning the grip-enhancing structure relative to the mold's interior surface may be used, as the above examples are a non-exclusive set of illustrative examples.

The interior surface of the mold may be a smooth surface, in which case the grip-enhancing structure and foamed material may be used to produce a play ball with a smooth exterior surface in which the exterior portions of the grip-enhancing structure and the foamed material are at generally the same level. However it is also within the scope of the present disclosure that the mold's interior surface may include recesses that are sized to receive the grip-enhancing structure therein. In such a construction, the grip-enhancing structure will tend to project outwardly from the foamed material. In a further variation, the mold's interior surface may include mounts or other projections that are adapted to extend into the mold cavity to engage the grip-enhancing structure.

In each of these illustrative examples of positioning steps, the grip-enhancing structure is preformed relative to the foamed portion of the play ball. This does not require, in all embodiments, that the grip-enhancing structure is preformed prior to being inserted into the mold cavity. For example, a liquid material from which grip-enhancing structure is formed upon curing (through any suitable method or process) may be applied to regions of the mold cavity, such as recesses within the mold cavity. However, in many embodiments, the grip-enhancing structure will be formed prior to being inserted into the mold cavity, such as by molding, cutting, stamping, and/or another suitable process, and thereafter positioned in the mold.

When the grip-enhancing structure is bonded to the interior surface of the mold, any suitable adhesive or other bonding agent may be used. The mold cavity may be smooth or otherwise not define predetermined locations for grip-enhancing structure. Additionally or alternatively, the mold may define regions to which the grip-enhancing structure is to be bonded. Illustrative, somewhat schematic examples of molds, or mold portions, 80 that include interior surfaces 82 to which grip-enhancing structure 40 is bonded are shown in FIGS. 25 and 26.

Figure 25:
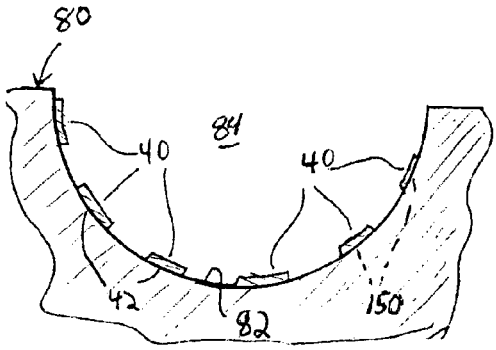
FIG. 25 is a fragmentary cross-sectional view of a portion of a mold having an interior surface to which grip-enhancing structure is bonded during formation of an enhanced-grip play ball according to the present disclosure.
Figure 26:
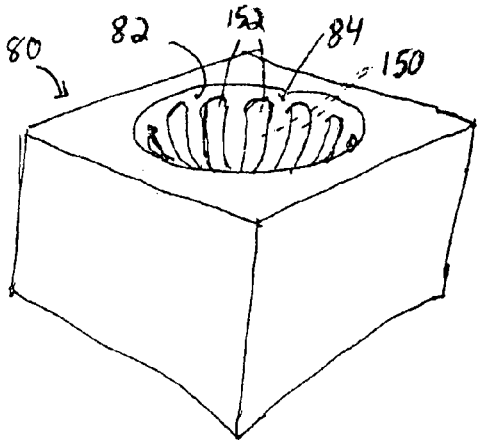
FIG. 26 is an isometric view of a portion of another mold having an interior surface to which grip-enhancing structure may be bonded during formation of an enhanced-grip play ball according to the present disclosure.

In FIG. 25, the mold cavity has a smooth interior surface 82 that has a smooth configuration to which grip-enhancing structure 40 may be adhesively bonded, such as with a suitable bonding agent 150. In FIG. 26, the mold's interior surface includes recesses 152 that define positions, or mounts, into which the grip-enhancing structure may be at least partially inserted after application of a suitable bonding agent 150 to the recess and/or grip-enhancing structure. It should be understood that the bonding step refers to releasably securing processes, such as which utilize weak adhesive bonds that are broken when the ball and the corresponding mold portion are drawn away from the mold (and without damaging the ball).

When the grip-enhancing structure is mechanically attached to the mold's interior surface, the mechanical attachment step also refers to a process that is adapted to only temporarily retain the grip-enhancing structure in a selected position relative to the mold's interior surface. For example, this step may utilize releasable fastening or retention mechanisms that are designed to release the grip-enhancing structure when the ball and the corresponding mold portion are drawn away from each other. However, unlike a chemical process, the mechanical attachment utilizes friction or a similar mechanical mechanism to retain the grip-enhancing structure in a selected, or defined, position relative to the mold's interior surface.

Illustrative examples of suitable mechanisms for mechanically attaching the grip-enhancing structure to the mold include forming internal recesses that extend generally into the mold and away from the mold's internal cavity 84 and/or including projections, or projecting members, that generally extend away from the mold's interior surface and into the mold's internal cavity. These recesses and/or projections are adapted to mechanically couple to the grip-enhancing structure to frictionally retain the grip-enhancing structure in a selected position, or range of positions, relative to the mold's interior surface. In some embodiments, the recesses and/or projections may be adapted to apply compression to the grip-enhancing structure. When the corresponding portion of the mold's interior surface has a concave configuration, this compression urges the grip-enhancing structure against the mold and/or to conform to the shape of the mold's interior surface against which it is compressed. The above references to the recesses being coupled to the grip-enhancing structure and/or applying compression thereto may alternatively be described in the context of sidewalls or other surface(s) that define the recess and which engage the grip-enhancing structure and/or apply compression thereto. The recesses and projections described above may additionally or alternatively be referred to as mounts that form a portion of the mold and which are adapted to mechanically retain the grip-enhancing structure in a defined or selected position relative to the mold's interior surface.

Figure 27:
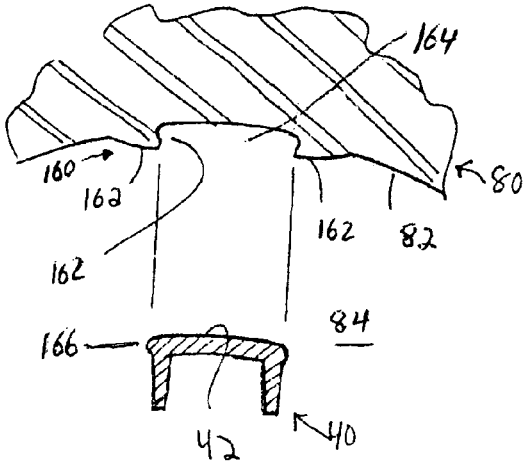
FIG. 27 is a fragmentary cross-sectional view showing a portion of a grip-enhancing structure and a portion of a mold that is adapted to mechanically attach to the grip-enhancing structure during formation of an enhanced-grip play ball according to the present disclosure.
Figure 28:
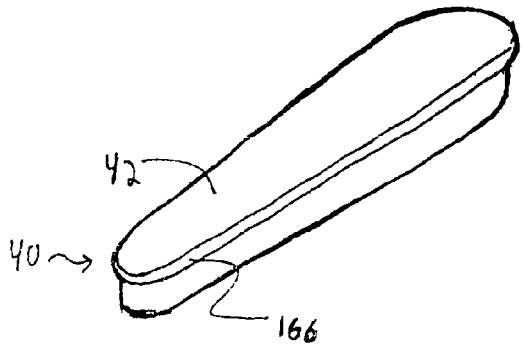
FIG. 28 is a perspective view of another illustrative example of a suitable construction for grip-enhancing structure that may be used to form play balls according to the present disclosure.

FIG. 27 illustrates a portion of a mold 80 having an interior surface 82 that defines an internal cavity 84 and which includes mounts 160 that are adapted to receive and mechanically retain grip-enhancing structure 40 relative to the interior surface of the mold. As illustrated, the mounts take the form of projections 162 that define a socket, or channel, 164 therebetween. Socket 164 is sized to receive a corresponding portion of the grip-enhancing structure, such as a portion of the structure's exterior surface 42, therein. In some embodiments, it may be desirable to slightly undersize the channel relative to the corresponding portion of the grip-enhancing structure so that compression is applied to the grip-enhancing structure, thereby providing additional retentive forces and/or urging the grip-enhancing structure against the mold. In the illustrative example shown in FIG. 27, the projections are convergently oriented toward each other. Described in slightly different terms, FIG. 27 illustrates projections that define an undercut into which at least a portion of the grip-enhancing structure, such as a perimeter flange 166 thereof, may extend when the grip-enhancing structure is mechanically coupled to the mold by the mounts. FIG. 28 provides an illustrative, non-exclusive example of a grip-enhancing structure 40 having a perimeter flange 166 that is sized for receipt into the undercuts defined by the projections.

Figure 29:
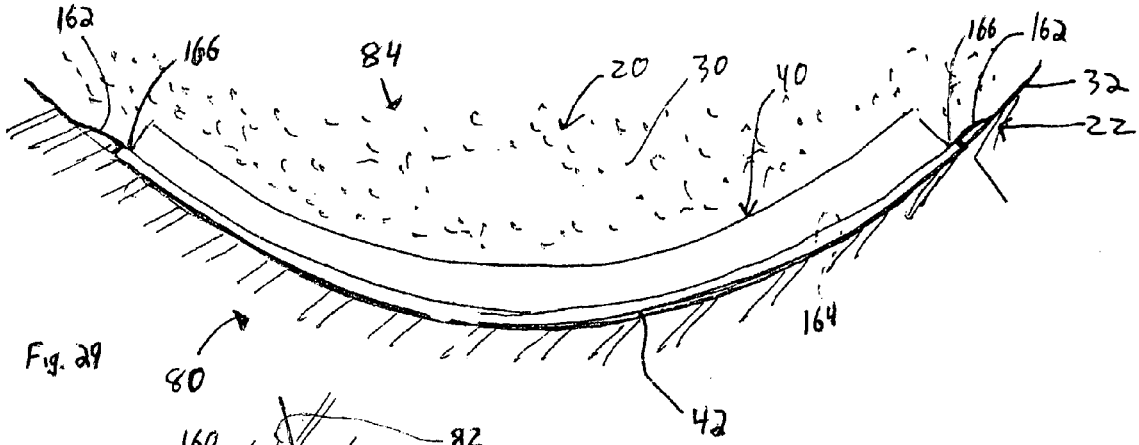
FIG. 29 is a fragmentary cross-sectional view showing a portion of another grip-enhancing structure and a portion of another mold that is adapted to mechanically attach to the grip-enhancing structure during formation of an enhanced-grip play ball according to the present disclosure.
Figure 30:
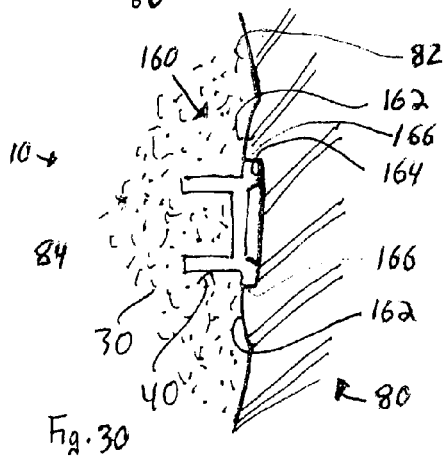
FIG. 30 is a fragmentary cross-sectional view showing a portion of another grip-enhancing structure and a portion of another mold that is adapted to mechanically attach to the grip-enhancing structure during formation of an enhanced-grip play ball according to the present disclosure.
Figure 33:
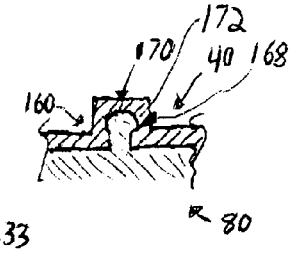
FIG. 33 is a fragmentary cross-sectional view showing a variation of the projecting structure and the corresponding grip-enhancing structure socket shown in FIG. 31.
Figure 32:
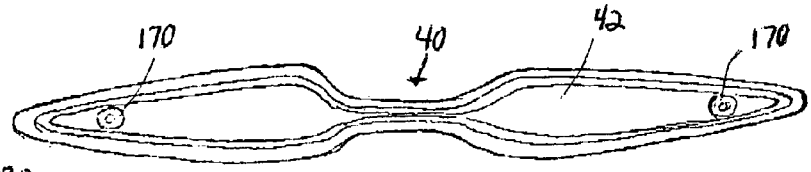
FIG. 32 is a rear elevation view of a grip-enhancing structure that may be used to form play balls according to the present disclosure with the mold of FIG. 31.
Figure 31:
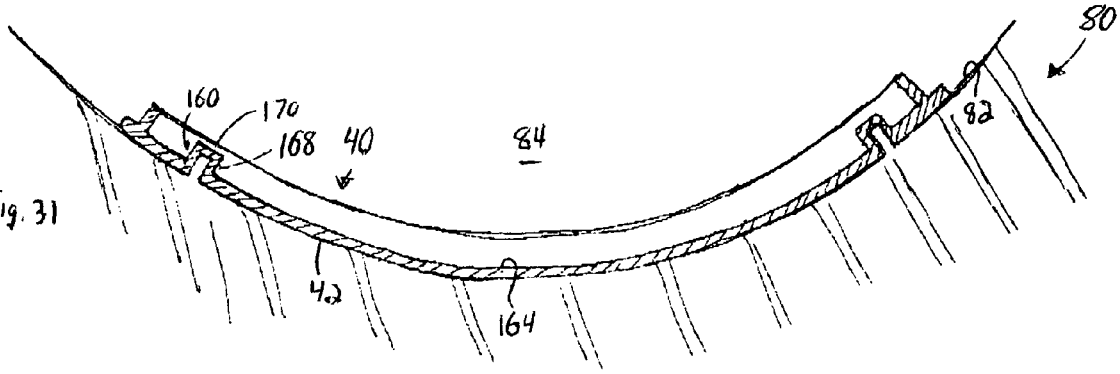
FIG. 31 is a fragmentary cross-sectional view showing a grip-enhancing structure and a portion of another mold that is adapted to mechanically attach to the grip-enhancing structure during formation of an enhanced-grip play ball according to the present disclosure.

FIGS. 29 and 30 provide additional examples of molds with mounts 160 in the form of projections 162 that define a socket, or channel, 164 therebetween and into which a grip-enhancing structure is frictionally retained, optionally with additional compression being applied to the portion of the grip-enhancing structure that extends between the projections. It is within the scope of the present disclosure that mounts 160 may instead define recesses with sidewalls that define the above-discussed channel and optionally apply the above-discussed compression. A further example of a suitable structure for mounts 160 is shown in FIG. 31, in which the mounts take the form of pins 168 that project generally away from the interior surface 82 of the mold and generally into the mold cavity 84. As shown, pins 168 are adapted to be received into apertures, bores, or other suitable sockets 170 in a corresponding grip-enhancing structure 40. An illustrative, non-exclusive example of a suitable grip-enhancing structure 40 is shown in FIG. 32. In FIG. 33, another example of a suitable configuration for pins 168 is shown, with the pins of FIG. 33 including heads 172 of larger cross-section than the shafts upon which the heads are mounted.

As discussed, mounts 160 may be adapted to apply compression to the grip-enhancing structure to conform this structure to the interior surface 82 of the mold. This compressive force may (but is not required to in all embodiments) also provide a temporary seal between the grip-enhancing structure and the mold. This seal may restrict the foamed material from extending over the exterior portion 42 of the grip-enhancing structure (i.e., the surface of the grip-enhancing structure that faces the interior surface of the mold) when the foamed material is injected or otherwise inserted into the mold.

As indicated above, when a molding process is used to construct a play ball 10 according to the present disclosure, it is desirable to restrict the foamed material from extending over the exterior surface of the grip-enhancing structure. Recessing the grip-enhancing structure within a recess in the mold is one method that may be used to accomplish this objective. Others include compressing the grip-enhancing structure against the interior surface of the mold and/or to provide a mount that extends into the mold cavity and extends around the perimeter of the grip-enhancing structure. When the perimeter of the grip-enhancing structure is not enclosed within a mount or recess, the perimeter of the grip-enhancing structure may itself be adapted to form a temporary seal with the interior surface of the mold to prevent the foamed material from passing between the grip-enhancing structure and the mold when the foamed material is inserted into the mold.

FIGS. 34-37 illustrate examples of play balls 10, or components thereof, that are constructed with grip-enhancing structure 40 that include deflectable perimeter flanges 90 that are adapted to form seals, or barrier interfaces with the interior surface 82 of the mold 80 to prevent the foamed material from passing therebetween when the foamed material is inserted into the mold. As perhaps best seen in FIG. 36, the flange 90 is configured so that the pressure of foamed material 30 against the flange urges the flange against the interior surface of the mold, thereby restricting the foamed material from being able to pass between the flange and the interior surface of the mold. As shown, flange 90 includes lateral regions 92 that extend along the interior surface of the mold. The compressive sealing forces exerted by the foamed material are schematically illustrated with arrows on the left side of FIG. 36.

Figure 38:
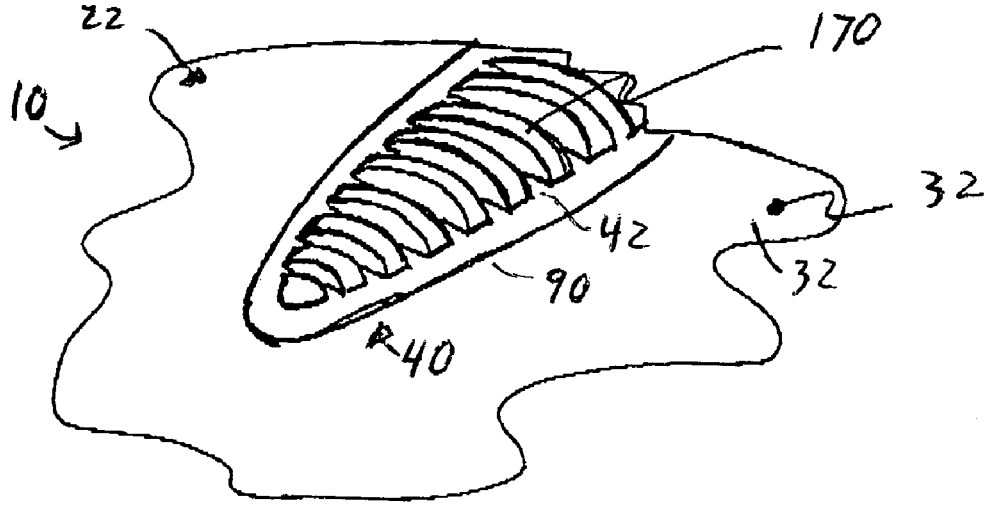
FIG. 38 is a fragmentary isometric view of an exterior surface portion of another enhanced-grip play ball according to the present disclosure.
Figure 39:
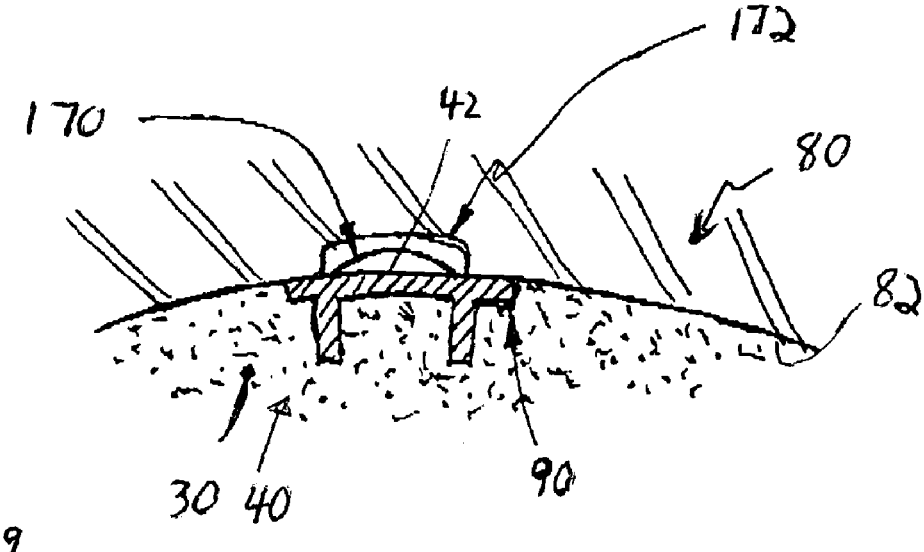
FIG. 39 is a fragmentary cross-sectional view showing the enhanced-grip play ball of FIG. 38 and a portion of another mold that may be used to form the enhanced-grip play ball according to the present disclosure.

Although not required, in the illustrated examples shown in FIGS. 36 and 37, the grip-enhancing structure 40 includes a pair of generally opposed flanges 90 that project generally away from each other to define a central recess 94 in the grip-enhancing structure. Grip-enhancing structure 40 may be formed without this recess. As a further example, FIGS. 38 and 39 illustrate examples of play balls 10 that include projecting tread structures 170 that extend from the exterior surface 42 of grip-enhancing structure 40, such as from a region generally between the perimeter flanges 90 of the grip-enhancing structure. In such an embodiment, and as indicated in FIG. 39, the mold may define recesses 172 that are sized (and optionally being oversized) to receive the projecting tread structure, with the seals created by the perimeter flanges restricting the foamed material from extending into these recesses. When the grip-enhancing structure, or at least the exterior surface thereof, is itself received into a recess that is sized to receive, and optionally seal around the perimeter of, the grip-enhancing structure, the recess may be sized to also define space for the projecting tread structure.

When the grip-enhancing structure includes an internal frame portion or is coupled to an internal frame that extends within the body of the play ball, the grip-enhancing structure and this frame or support may be positioned within the mold simply by placing this structure within the mold. In other words, the frame or support may sufficiently urge the grip-enhancing structure against the mold's internal surface to position the grip-enhancing structure against this surface of the mold. The previously discussed inserts may also provide this positioning. As also discussed, the support or frame may include mounts that are adapted to interconnect with the grip-enhancing structure, either generally or by engaging corresponding receivers or coupling structure on the grip-enhancing structure. It is also within the scope of the present disclosure that the supports, frames, and/or inserts physically contact the grip-enhancing structure to urge the structure against the mold, without having a chemical bond or mechanical linkage between the grip-enhancing structure and the support or frame (i.e., a linkage that would remain if this structure was removed from the mold). Instead, adjacent surfaces of this structure are pressed against each other to urge the grip-enhancing structure against the interior surface of the mold. This biasing of the grip-enhancing structure may be provided by the frames, supports, and/or inserts that are described, illustrated and/or incorporated herein. As also discussed, this biasing may be utilized in combination with other processes or steps, such as the bonding, mechanically attaching, and/or compressing steps described, illustrated and/or incorporated herein. This optional biasing step is schematically illustrated in dashed lines in FIG. 24 at 140.

After positioning the grip-enhancing structure within the mold, such as in a selected or predefined position relative to the mold's interior surface, the foamed material is then inserted into the mold cavity. This is indicated in FIG. 24 at 142. This insertion of the foamed material may be via any suitable process. Illustrative, non-exclusive examples include injecting the foamed material into the mold cavity and positioning the recently mixed, or to-be-mixed, components of a foamed material that requires two or more components to be mixed together to actuate the chemical reaction that forms the foamed material. Accordingly, the inserting step may include inserting one or more materials that are not foamed when first inserted into the mold cavity, but which are subsequently foamed during the production of the play ball. The insertion step may also include curing the foamed material, such as may utilize any suitable process or mechanism to solidify or otherwise set the particular foamed material being utilized. At 144, the play ball is removed from the mold. At 146, it is indicated that play balls 10 may, but are not required to, undergo some processing after removing the ball from the mold. Examples of such processing include final shaping of the ball, such as of portions of the foamed material, removing excess material (if present), treating a portion (or all) of the exterior surface of the ball (such as by applying a coating thereto), etc.

As discussed above, grip-enhancing structure 40 may include a single length of material, discrete regions of material that are joined by internal bridging, or linking, structure that extends beneath the exterior surface of the play ball, or separate regions of material that are positioned relative to each other by an internal frame or support that extends within the body of the play ball and beneath the exterior surface of the play ball. When the grip-enhancing structure is formed from a single length of material (or single extent of interconnected exterior portions), this material may be supported by an internal frame or support that extends within the body of the play ball and beneath the exterior surface of the play ball. Many of the above examples illustrate methods in conjunction with a plurality of separate grip-enhancing structures. It is within the scope of the present disclosure that any of the grip-enhancing structures disclosed, illustrated and/or incorporated herein may be utilized, including grip-enhancing structures that include internal projections and/or linkages.

As discussed, play balls according to the present disclosure have discrete regions of two different materials on the exterior surface thereof, with one of these materials being a foamed material and the other forming a grip-enhancing material that forms an enhanced-grip region of the play ball's exterior surface. The enhanced-grip region may be described as including a grip-enhancing structure that is formed from a different material than the foamed material. This difference in material may relate to one or more of the compositions, densities, porosities, friction, coefficient of friction, weight, tackiness, compressibility, and the like of the material(s) from which the foamed region is formed and the material(s) from which the grip-enhancing structure is formed. In some embodiments, the grip-enhancing structure is formed from an elastomer, such as an elastomer that provides a higher friction surface that promotes a surer grip than if the grip-enhancing structure was not present on the play ball's exterior surface. The two different materials may be of the same or different colors, may be different textures, may provide regions for graphic treatments, may include bumps, ridges, indentations, textures, and the like. Although not required, the use of two different, separately added materials to form the exterior surface of the play ball offers manufacturing options for color and/or texture breaks between these materials, which may provide aesthetic options not available with conventional play balls.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

I claim:

1. An enhanced-grip play ball, comprising:

a resilient, compressible body that is at least substantially formed from a foamed material and which includes an exterior surface that is at least partially formed from the foamed material; and a grip-enhancing structure including an exterior portion that forms at least a portion of the exterior surface of the body and an internal portion that extends beneath the exterior surface of the body and into the foamed material, wherein the grip-enhancing structure is formed from a grip-enhancing material having at least one of a greater friction and a greater tackiness than the foamed material; wherein the exterior portion of the grip-enhancing structure includes a plurality of spaced-apart exterior regions that are separated on the exterior surface of the body of the play ball by the foamed material; and further wherein the internal portion of the grip-enhancing structure includes a plurality of linkages that extend beneath the exterior surface of the body of the play ball and which interconnect the exterior regions of the grip-enhancing structure.

2. The enhanced-grip play ball of claim 1, wherein the grip-enhancing structure is formed from an elastomer.

3. The enhanced-grip play ball of claim 1, wherein the grip-enhancing structure is not formed from a foamed material.

4. The enhanced-grip play ball of claim 1, wherein the grip-enhancing structure has a greater coefficient of friction than the foamed material.

5. The enhanced-grip play ball of claim 1, wherein the foamed material has a greater porosity than the grip-enhancing structure.

6. The enhanced-grip play ball of claim 1, wherein the grip-enhancing structure includes a projecting tread structure.

7. The enhanced-grip play ball of claim 1, wherein the play ball further includes an internal support within the body.

8. The enhanced-grip play ball of claim 1, wherein the body includes at least one of a hollow cavity and a solid core.

9. The enhanced-grip play ball of claim 7, wherein the internal support supports the internal portion of the grip-enhancing structure.

10. The enhanced-grip play ball of claim 1, wherein the foamed material extends around the internal portion of the grip-enhancing structure.

11. The enhanced-grip play ball of claim 1, wherein the foamed material extends around the plurality of linkages of the grip-enhancing structure.

12. The enhanced-grip play ball of claim 1, wherein the body has a cross-sectional area of less than 100 $in^2$.

13. The enhanced-grip play ball of claim 1, wherein the body has a cross-sectional area of less than 50 $in^2$.

14. The enhanced-grip play ball of claim 1, wherein the body has a cross-sectional area of 10-40 $in^2$.

* * * * *